US011460794B2

(12) United States Patent
Mukoyama et al.

(10) Patent No.: US 11,460,794 B2
(45) Date of Patent: Oct. 4, 2022

(54) IMAGE RECORDING APPARATUS

(71) Applicant: CANON KABUSHIKI KAISHA, Tokyo (JP)

(72) Inventors: Yumi Mukoyama, Kanagawa (JP); Tetsuya Ishikawa, Kanagawa (JP); Tsuyoshi Saeki, Kanagawa (JP); Yoshiyuki Kurita, Saitama (JP); Takashi Abe, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/336,584

(22) Filed: Jun. 2, 2021

(65) Prior Publication Data

US 2021/0382423 A1 Dec. 9, 2021

(30) Foreign Application Priority Data

Jun. 9, 2020 (JP) ..... JP2020-100437

(51) Int. Cl.
*G03G 15/20* (2006.01)
*B41J 11/00* (2006.01)

(52) U.S. Cl.
CPC ..... *G03G 15/2053* (2013.01); *B41J 11/002* (2013.01); *G03G 15/2028* (2013.01)

(58) Field of Classification Search
CPC ..... G03G 15/2053; G03G 15/2028; G03G 15/234; B41J 11/002; B41J 11/0022; B41J 13/0045; B41J 11/0024
See application file for complete search history.

(56) References Cited

U.S. PATENT DOCUMENTS

| | | | |
|---|---|---|---|
| 4,684,962 | A | 8/1987 | Hirosawa et al. |
| 4,698,650 | A | 10/1987 | Watanabe et al. |
| 5,019,840 | A | 5/1991 | Watanabe et al. |
| 5,311,214 | A | 5/1994 | Hirasawa et al. |
| 5,339,098 | A | 8/1994 | Nagatomo et al. |
| 5,548,308 | A | 8/1996 | Nagatomo et al. |
| 5,971,525 | A | 10/1999 | Inoue et al. |
| 6,142,599 | A | 11/2000 | Ishinaga et al. |
| 6,151,051 | A | 11/2000 | Ikeda et al. |
| 6,196,655 | B1 | 3/2001 | Hirasawa et al. |
| 6,435,675 | B2 | 8/2002 | Okura et al. |
| 7,048,356 | B2 | 5/2006 | Ishikawa et al. |

(Continued)

FOREIGN PATENT DOCUMENTS

JP H05-104708 A 4/1993

*Primary Examiner* — Bradley W Thies
(74) *Attorney, Agent, or Firm* — Venable LLP

(57) ABSTRACT

An image recording apparatus includes a stacking portion on which a recording medium is stacked; a recording portion for recording an image on the recording medium; a heating portion for heating the recording medium recorded by the recording portion; a discharge portion for discharging the recording medium recorded by the recording portion; a first path for conveying the recording medium in order of the stacking portion, the recording portion, the heating portion, and the discharge portion; a second path branching off from the first path between the recording portion and the heating portion, and merging with the first path downstream of the heating portion; and a third path for connecting the second path and a part of the first path between the stacking portion and the recording portion, and inverting a recording surface of the recording medium.

14 Claims, 11 Drawing Sheets

(56) References Cited

U.S. PATENT DOCUMENTS

| | | | |
|---|---|---|---|
| 7,226,157 | B2 | 6/2007 | Nakazawa et al. |
| 7,661,786 | B2 | 2/2010 | Nakazawa et al. |
| 7,866,789 | B2 | 1/2011 | Shigeno et al. |
| 8,262,216 | B2 | 9/2012 | Hamano et al. |
| 8,348,401 | B2 | 1/2013 | Sekino et al. |
| 8,443,985 | B2 | 5/2013 | Aoyama et al. |
| 8,602,538 | B2 | 12/2013 | Sekino et al. |
| 8,651,638 | B2 | 2/2014 | Ishikawa |
| 8,876,280 | B2 | 11/2014 | Ishikawa et al. |
| 9,004,640 | B2 | 4/2015 | Ishikawa et al. |
| 9,415,960 | B2 | 8/2016 | Asano et al. |
| 10,406,838 | B2 | 9/2019 | Ohashi et al. |
| 10,596,820 | B2 | 3/2020 | Abe et al. |
| 10,632,758 | B2 * | 4/2020 | Kosuge ..... B41J 2/19 |
| 10,723,153 | B2 | 7/2020 | Ohashi et al. |
| 10,766,265 | B2 | 9/2020 | Tokisawa et al. |
| 10,843,480 | B2 | 11/2020 | Arai et al. |
| 10,960,678 | B2 | 3/2021 | Kosuge et al. |
| 10,974,527 | B2 | 4/2021 | Ohashi et al. |
| 2011/0090271 | A1 | 4/2011 | Shigeno et al. |
| 2018/0236791 | A1 | 8/2018 | Ohashi et al. |
| 2020/0180320 | A1 | 6/2020 | Abe et al. |
| 2020/0316967 | A1 | 10/2020 | Ohashi et al. |
| 2021/0178777 | A1 | 6/2021 | Kosuge et al. |

* cited by examiner

FIG. 6

| RECORDING PATTERN | FIRST SURFACE RECORDING | FIRST SURFACE DRYING | SECOND SURFACE RECORDING | SECOND SURFACE DRYING | CONVEYING PATH |
|---|---|---|---|---|---|
| 1 | PERFORMED | PERFORMED | NON-PERFORMED | — | MAIN |
| 2 | PERFORMED | NON-PERFORMED | NON-PERFORMED | — | MAIN→SUB (FORWARD) |
| 3 | NON-PERFORMED | — | PERFORMED | PERFORMED | MAIN→SUB (FORWARD)→SUB (BACKWARD) →INVERSION→MAIN |
| 4 | NON-PERFORMED | — | PERFORMED | NON-PERFORMED | MAIN→SUB (FORWARD)→SUB (BACKWARD) →INVERSION→MAIN→SUB (FORWARD) |
| 5 | PERFORMED | PERFORMED | PERFORMED | PERFORMED | MAIN→SUB (BACKWARD) →INVERSION→MAIN |
| 6 | PERFORMED | PERFORMED | PERFORMED | NON-PERFORMED | MAIN→SUB (BACKWARD) →INVERSION→MAIN →SUB (FORWARD) |
| 7 | PERFORMED | NON-PERFORMED | PERFORMED | PERFORMED | MAIN→SUB (FORWARD) →SUB (BACKWARD)→INVERSION→MAIN |
| 8 | PERFORMED | NON-PERFORMED | PERFORMED | NON-PERFORMED | MAIN→SUB (FORWARD)→SUB (BACKWARD) →INVERSION→MAIN→SUB (FORWARD) |

IMAGE RECORDING APPARATUS

BACKGROUND OF THE INVENTION

Field of the Invention

The present invention relates to an image recording apparatus provided with a heat drying portion for promoting heat drying on a recording medium having an image recorded thereon.

Description of the Related Art

Conventionally, as an ink jet type recording apparatus for recording an image by discharging an ink to a recording medium, a recording apparatus is known which is adapted to implement recording on various recording media by being made to be able to select whether or not a recording medium is passed through a heat drying portion. For example, Japanese Patent Application Publication No. H05-104708 discloses a configuration enabling selection of whether heat drying is performed or not by having two paper discharge conveying paths, and including a heat drying portion disposed at one of the paper discharge conveying paths.

SUMMARY OF THE INVENTION

However, in the configuration disclosed in Japanese Patent Application Publication No. H05-104708, a conveying path for performing double-sided recording is not provided. As a result, for performing recording on the back surface (second surface) of the recording medium, it is necessary, after completion of the recording operation on the front surface (first surface), to set the recording medium at a paper feed portion again, and select whether heat drying is performed or not by inputting of a record command. This unfavorably results in low usability. Further, addition of a double-side conveying path to the configuration of Japanese Patent Application Publication No. H05-104708 may unfavorably result in an increase in apparatus size.

It is an object of the present invention to provide an image recording apparatus capable of selecting whether heat drying is performed or not on each surface of the recording medium, and being suppressed in increase in apparatus size in the configuration capable of carrying out double-sided recording.

In order to solve the foregoing problem, the image recording apparatus of the present invention includes:

- a stacking portion on which a recording medium is stacked;
- a recording portion for recording an image on the recording medium;
- a heating portion for heating the recording medium recorded by the recording portion;
- a discharge portion for discharging the recording medium recorded by the recording portion;

a first path for conveying the recording medium in order of the stacking portion, the recording portion, the heating portion, and the discharge portion;

a second path branching off from the first path between the recording portion and the heating portion, and merging with the first path downstream of the heating portion; and

- a third path for connecting the second path and a part of the first path between the stacking portion and the recording portion, and inverting a recording surface of the recording medium.

With the image recording apparatus of the present invention configured as described above, a sub conveying path enables double-sided recording, and further, a main conveying path which is the conveying path going through the heat drying portion, and a sub conveying path which is a non-heat drying conveying path not going through the heat drying portion are included. As a result, it is easy to carry out double-sided recording, and it is possible to select whether heat drying for each surface of the recording medium is performed or not. Further, at the time of second surface recording, after passing through a part of the sub conveying path, a recording medium passes through the reversal conveying path, and is conveyed upstream of the recording portion. This can suppress the increase in apparatus size.

Further features of the present invention will become apparent from the following description of exemplary embodiments with reference to the attached drawings.

BRIEF DESCRIPTION OF THE DRAWINGS

FIG. 6 is a view showing the difference in conveying path according to the combination of the recording surface and drying or non-drying;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment

Figure 1:
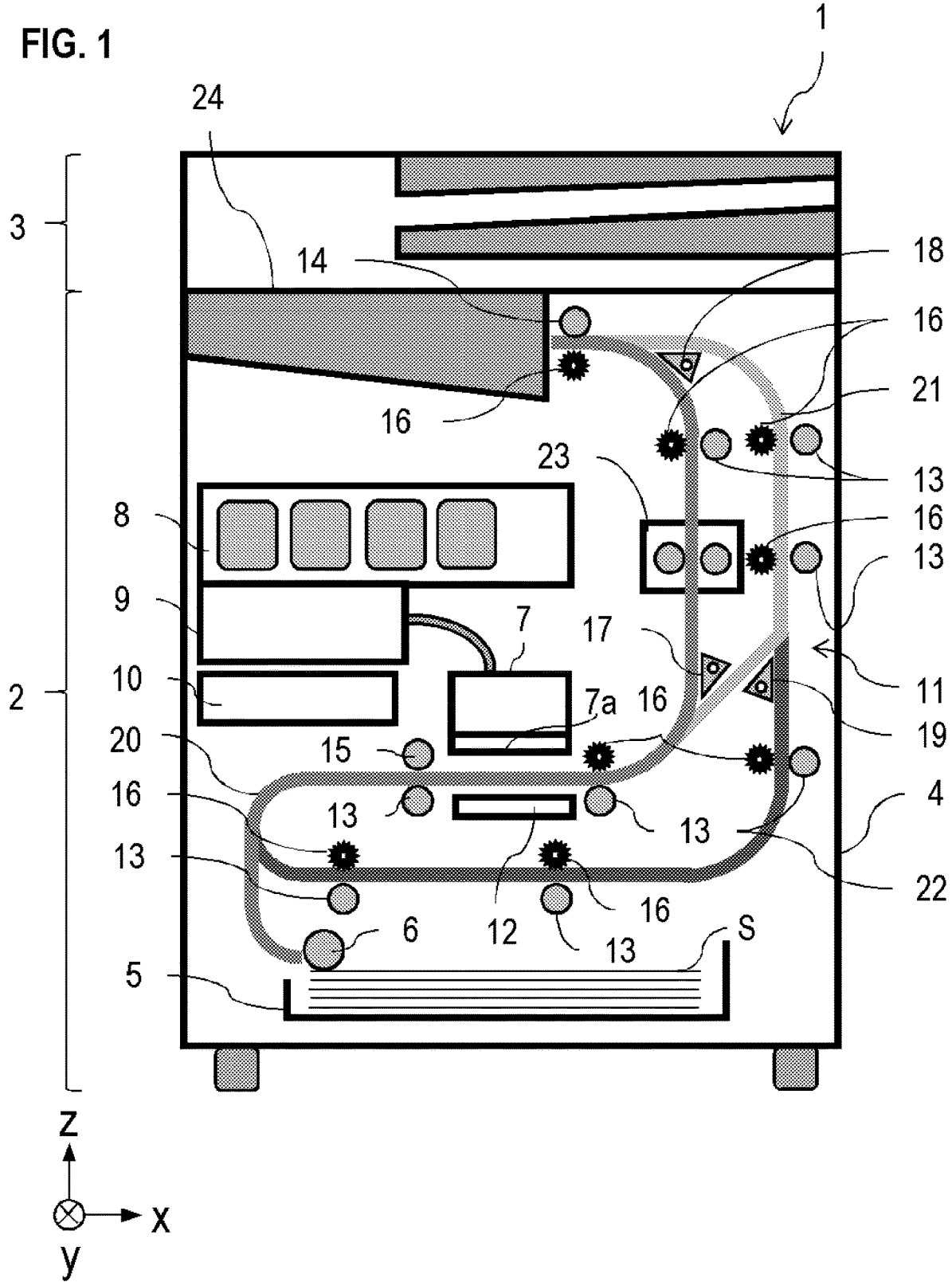
FIG. 1 is an internal configuration view of an image recording apparatus of an embodiment.

FIG. 1 is an internal configuration view of an ink jet recording apparatus 1 of an embodiment of the present invention (below, a recording apparatus 1). In the drawing, the x direction denotes the horizontal direction; the y direction (direction perpendicular to the paper plane), the direction in which the discharge ports are arrayed in a recording head 7 described later; and the z direction, the vertical direction.

The recording apparatus 1 is a multi-purpose machine (image recording apparatus) including a print portion 2 as an image recording portion (image recording device), and a scanner portion 3 as an image reading portion (image reading device). The recording apparatus 1 can execute various processing regarding the recording operation and the reading operation at the print portion 2 and the scanner portion 3 separately or in conjunction with each other. The scanner portion 3 includes an auto document feeder (ADF) and a flat head scanner (FBS), and can perform reading of the document sheets to be automatically fed by the ADF, and reading (scanning) of the document sheets placed on the document sheet holder of the FBS by a user. Incidentally, the recording apparatus in accordance with the present embodiment is a multi-purpose machine having both the print portion 2 and the scanner portion 3, and may be in a form not having the scanner portion 3. FIG. 1 shows the recording apparatus 1 in a wait state in which the recording apparatus 1 performs neither of the recording operation and the reading operation. The print portion 2 includes a housing 4, a cassette 5, a feed unit 6, a recording head 7, an ink tank unit 8, an ink feed unit 9, a maintenance unit 10, a conveyance unit 11, a heating portion 23, and the like.

The cassette 5 is for accommodating a recording medium S, and is at the bottom in the vertically downward direction of the housing 4, and is detachably set. The feed unit 6 is provided in the vicinity of the cassette 5, and separates the accommodated recording media S one by one, and feeds the recording medium S for performing the recording operation. When the recording operation is performed, the recording medium S is fed from the cassette 5. Incidentally, the stacking portion of the recording medium in the present invention is not limited to the cassette 5, and includes, for example, the paper feeding configuration using a so-called manual feeding tray capable of feeding paper from the side surface of the housing 4.

The recording head 7 is a full line type color ink jet recording head, in which discharge ports each for discharging an ink according to the recorded data are arrayed in plural number corresponding to the width of the recording medium S along the y direction in FIG. 1. Further, the recording head 7 is movable, and the discharge port surface 7*a* of the recording head 7 moves to the position (which will be referred to as the recording position) opposite to a platen 12 described later when the recording operation is performed.

The ink tank unit 8 stores each ink of four colors to be fed to the recording head 7. The ink feed unit 9 is provided partway in the passage for connecting the ink tank unit 8 and the recording head 7, and adjusts the pressure and the flow rate of each ink in the recording head 7. In the present embodiment, the circulation type ink feed system is adopted, and the ink feed unit 9 adjusts the pressure of each ink to be fed to the recording head 7 and the flow rate of each ink to be collected from the recording head 7 within the proper range.

The maintenance unit 10 performs the maintenance operation on the recording head 7. The maintenance unit 10 operates a cap unit and a wiping unit not shown at a prescribed timing, thereby performing maintenance.

The conveyance unit 11 is for guiding the recording medium S in a prescribed direction, and includes the platen 12, a conveying roller 13, a discharge roller 14, a pinch roller 15, a spur 16, first flapper 17, a second flapper 18, a third flapper 19, and the like.

The platen 12 is provided at the position opposite to the discharge port surface 7*a* of the recording head 7 during the recording operation as described above. The platen 12 includes a plate extending in the y direction, and supports the recording medium S from the back surface so that the distance between the discharge port surface 7*a* and the recording medium S may become a prescribed value. Below, the region of the conveying path where the platen 12 is opposed to the recording head 7 will be referred to as a recording region (recording portion).

The conveying roller 13 is a driving roller for conveying the recording medium S on the conveying path, and to be driven by a conveying motor not shown. The discharge roller 14 is a driving roller provided most downstream on the conveying path, and to be driven by a conveying motor not shown. The pinch roller 15 is a roller for following the conveying roller 13 on the upstream side of the recording head 7, and rotating, nipping the recording medium S with the conveying roller 13. The spur 16 is disposed opposed to the conveying roller 13 or the discharge roller 14 on the downstream side of the recording head 7, and follows the conveying roller 13 or the discharge roller 14 by driving.

The first flapper 17, the second flapper 18, and the third flapper 19 are switching means for switching the guide path (conveying path) for the recording medium S, and is driven by an actuator not shown. The first flapper 17 switches the guide path for the recording medium S after passing through the recording portion between a main conveying path 20 (first path) and a sub conveying path 21 (second path) described later. The second flapper 18 and the third flapper 19 guide the recording medium S to the sub conveying path 21 (second path) and the reversal conveying path 22 (third path) described later, and convey the recording medium S to upstream of the recording portion after performing recording on the first surface for performing the recording operation on the second surface.

The recording medium S is guided to the conveying path by the foregoing conveyance unit 11, and are finally stacked and held on a discharge tray (sheet discharge tray) 24. Incidentally, the conveying path is divided to the main conveying path 20 (first path), the sub conveying path 21 (second path), and the reversal conveying path 22 (third path).

The main conveying path 20 is the conveying path for conveying the recording medium S to pass through the stacking portion, the recording portion, the heat drying portion, and the discharge portion in this order. Specifically, the main conveying path 20 is the conveying path passing from the feed unit 6 through the recording region including the recording head 7 and the platen 12, and passing through the heating portion 23 as a heat drying portion described later and extending to the discharge tray 24 through the discharge roller 14.

The sub conveying path 21 is a conveying path branched from between the recording region and the heating portion 23 in the main conveying path 20, and joining and connected to the main conveying path 20 on the downstream side in the conveying direction of the heating portion 23. The sub conveying path 21 is mainly used as the conveying path for the recording medium S not required to pass through the heating portion 23, and is partially used as the reversal conveying path for second surface recording. The recording medium S which has completely gone through the recording operation can switch whether or not heat drying is performed by being guided to either of the main conveying path 20 and the sub conveying path 21.

The reversal conveying path 22 is the conveying path for connecting the upstream side in the conveying direction of the recording region of the main conveying path 20 and the sub conveying path 21, and is used as the reversal conveying path for performing the recording operation on the second surface.

Herein, the heating portion 23 will be described in detail. The heating portion 23 heats the recording medium S which has completely gone through the recording operation, and thereby promotes drying of the recording medium S. This suppresses the deformation of the recording medium S due to the moisture of the ink, which results in the prevention of the jam in the conveying path, and an improvement of the aligning performance in the discharge tray 24.

Figure 2:
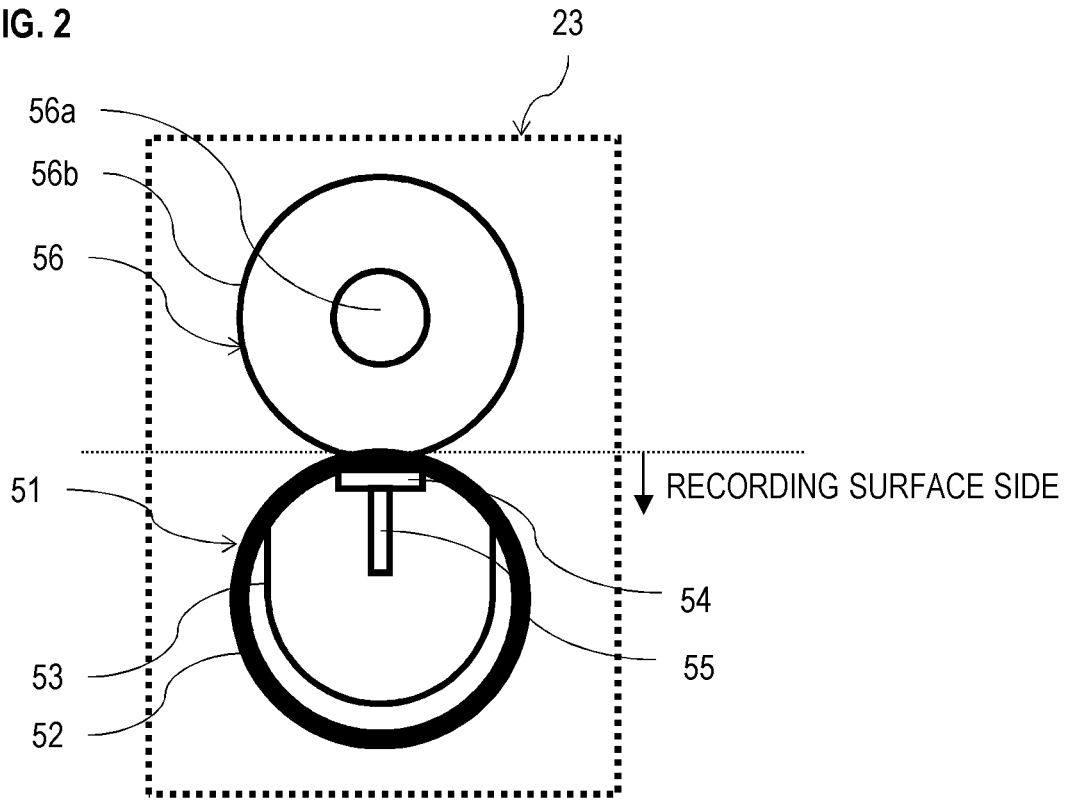
FIG. 2 is a cross sectional view of a heat drying portion.

FIG. 2 shows a detailed cross sectional view of the heating portion 23 of the present embodiment. The heating portion 23 includes a heat generation member 51 and a pressure roller 56, and these extend in the y direction so as to cover the width of the recording medium S with the maximum size. The heat generation member 51 includes a support member 53 for supporting a heating element 54. The heating element 54 is, for example, a ceramic heater, and extends in the y direction. The temperature of the heating element 54 is detected by a temperature sensor 55 typified by a thermistor. Driving of the heating element 54 is controlled based on the detection results. The support member 53 further supports a tubular film 52. The film 52 is formed in a cylindrical shape, and extends in the y direction. The film 52 has flexibility, and is supported by the support member 53 rotatably about the support member 53, and lies between the pressure roller 56 and the heating element 54. The film 52 is a monolayer film or a composite layer film with a film thickness of, for example, at least 10 μm and not more than 100 μm. In the case of the monolayer film, the material is, for example, PTFE, PFA, or FEP. In the case of the composite layer film, for example, the film is obtained by coating the layer of polyimide, polyamideimide, PEEK, PES, PPS, or the like with PTFE, PFA, FEP, or the like, or is a layer-structured film subjected to coating.

Incidentally, the heat generation member 51 is not limited to the foregoing configuration. For example, the structure is also acceptable in which a heating element such as a halogen heater is included in the inside of the core axis of a hollow metal, and an elastic body such as silicone rubber is coated around the core axis.

The pressure roller 56 is formed by coating the circumferential surface of the core metal 56*a* with an elastic body 56*b* such as silicone rubber. The pressure roller 56 is brought into pressure contact with the heat generation member 51 with a prescribed pressing force via the film 52, so that the pressure roller 56 and the heat generation member 51 form a nip part between the roller 56 and the film 52. The pressure roller 56 is rotated with a motor as a driving source, and the film 52 is rotated following the roller 56. With such a configuration, the recording medium S is heated by coming in contact with the film 52 as a heating member heated by the heat generation member 51 while being conveyed at the nip part, which can promote drying of the recording medium S.

Incidentally, the heating portion 23 may be not only the contact heating system shown in the present embodiment, but also, for example, the system for blowing warm air to the recording medium S (warm air system), or the system for promoting drying without contact with the recording medium S by providing an infrared heater in the vicinity of the recording medium S (non-contact heating system).

Figure 3:
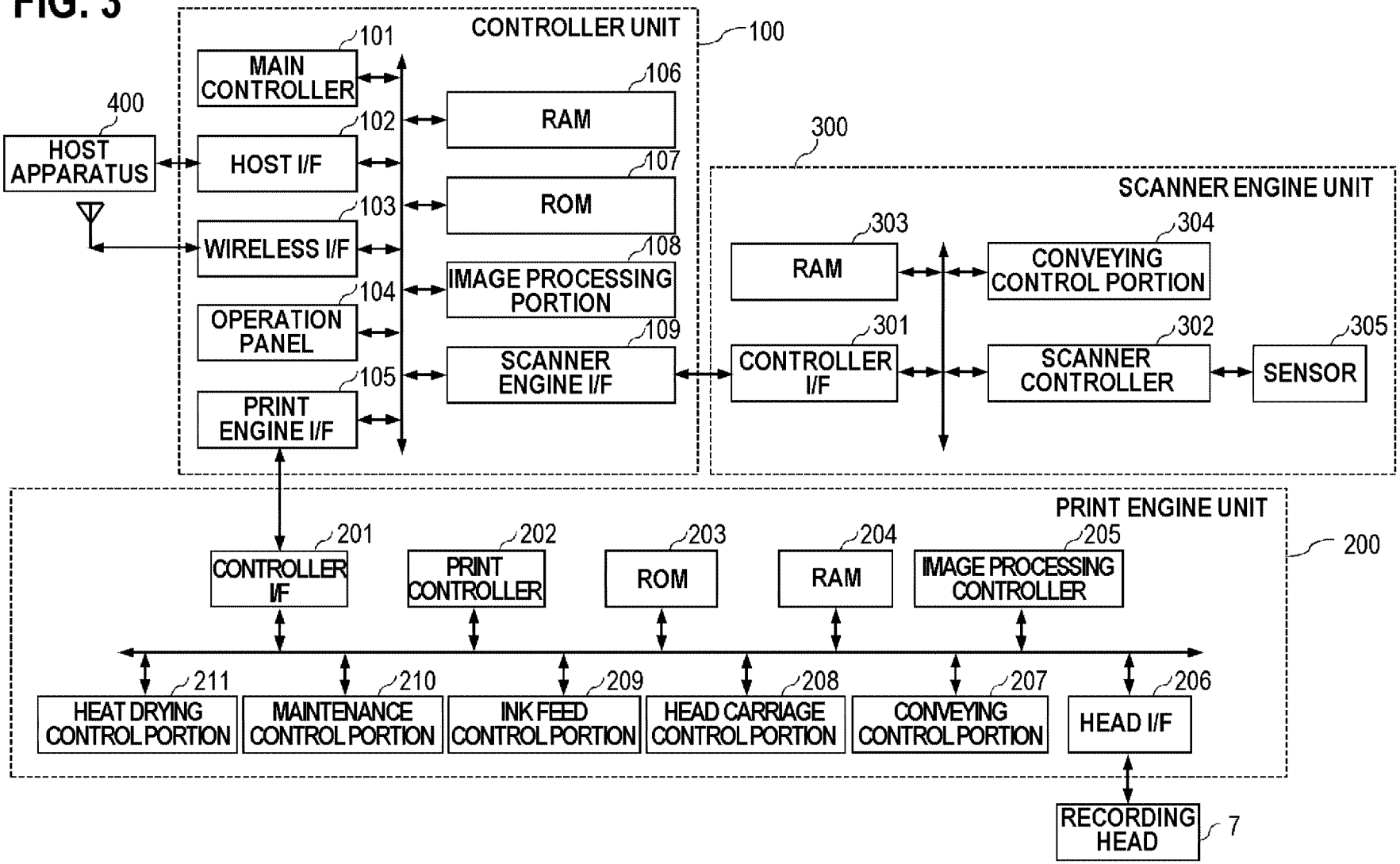
FIG. 3 is a block view showing the control configuration with a recording apparatus.

FIG. 3 is a block view showing the control configuration in the recording apparatus 1. The control configuration mainly includes a print engine unit 200 for supervising the print portion 2, a scanner engine unit 300 for supervising the scanner portion 3, and a controller unit 100 for supervising the whole recording apparatus 1. The print controller 202 controls various mechanisms of the print engine unit 200 according to the directions from the main controller 101 of the controller unit 100. The various mechanisms of the scanner engine unit 300 are controlled by the main controller 101 of the controller unit 100. Below, the details of the control configuration will be described.

In the controller unit 100, the main controller 101 formed of a CPU controls the whole recording apparatus 1 with a RAM 106 as a work area according to the program and various parameters stored in a ROM 107. For example, when a print job is inputted from a host apparatus 400 via a host I/F 102 or a wireless I/F 103, the image data received by an image processing portion 108 is subjected to prescribed image processing according to the directions from the main controller 101. Then, the main controller 101 transmits the image data subjected to image processing to the print engine unit 200 via a print engine I/F 105.

Incidentally, the recording apparatus 1 may acquire image data from the host apparatus 400 via radio communication or wire communication, or may acquire image data from an external storage device (such as a USB memory stick) connected to the recording apparatus 1. The communication system for use in radio communication or wire communication has no restriction. For example, as the communication system for use in radio communication, wireless fidelity (Wi-Fi) (registered trademark) or the Bluetooth (registered trademark) is applicable. Further, as the communication system for use in wire communication, universal serial bus (USB), or the like is applicable. Further, for example, when a read command is inputted from the host apparatus 400, the main controller 101 transmits the command to the scanner portion 3 via a scanner engine I/F 109.

An operation panel 104 is the mechanism for a user to perform input/output to/from the recording apparatus 1. A user can instruct the operations such as copying and scanning, can set the print mode, and can recognize the information of the recording apparatus 1 via the operation panel 104.

In the print engine unit 200, the print controller 202 formed of a CPU controls various mechanisms included in the print portion 2 with a RAM 204 as the work area according to the programs and various parameters stored in a ROM 203. When various commands and image data are received via a controller I/F 201, the print controller 202 stores this in the RAM 204 once. The print controller 202 causes an image processing controller 205 to convert the stored image data into recording data so that the recording head 7 can use the recording data for the recording operation.

When recording data is generated, the print controller 202 causes the recording head 7 to execute the recording operation based on the recording data via a head I/F 206. At this step, the print controller 202 drives the feed unit 6, the conveying roller 13, the discharge roller 14, and the flappers 17, 18 and 19 shown in FIG. 1 via a conveying control portion 207, and conveys the recording medium S. The recording operation by the recording head 7 is executed in conjunction with the conveying operation of the recording medium S according to the directions of the print controller 202, and print processing is performed.

A heat drying control portion 211 performs driving control of the heating element 54 and the pressure roller 56 according to whether heat drying by the heating portion 23 is executed or not. When heat drying of the recording medium S is performed, for example, heating of the heating element 54 and driving of the pressure roller 56 are performed before the recording medium S reaches the heating portion 23. Whether the recording medium S is subjected to heat drying or not is selectable according to the user operation on the operation panel 104 and the kind of the recording medium S.

A head carriage control portion 208 changes the orientation and the position of the recording head 7 according to the operation state such as the maintenance state or the recording state of the recording apparatus 1. An ink feed control portion 209 controls the ink feed unit 9 so that the pressure of each ink to be fed to the recording head 7 may fall within a proper range. A maintenance control portion 210 controls the operation of a cap unit or a wiping unit not shown in the maintenance unit 10 for performing the maintenance operation on the recording head 7.

In the scanner engine unit 300, the main controller 101 controls the hardware resources of the scanner controller 302 with the RAM 106 as the work area according to the programs and various parameters stored in the ROM 107. As a result, various mechanisms included in the scanner portion 3 are controlled. For example, the main controller 101 controls the hardware resources in the scanner controller 302 via the controller I/F 301. As a result, the document sheets mounted on an ADF by a user are conveyed via the conveying control portion 304, and are read by a sensor 305. Then, the scanner controller 302 stores the read image data in the RAM 303. Incidentally, the print controller 202 converts the image data acquired as described above into recording data, and thereby can cause the recording head 7 to execute the recording operation based on the image data read at the scanner controller 302.

Figure 4:
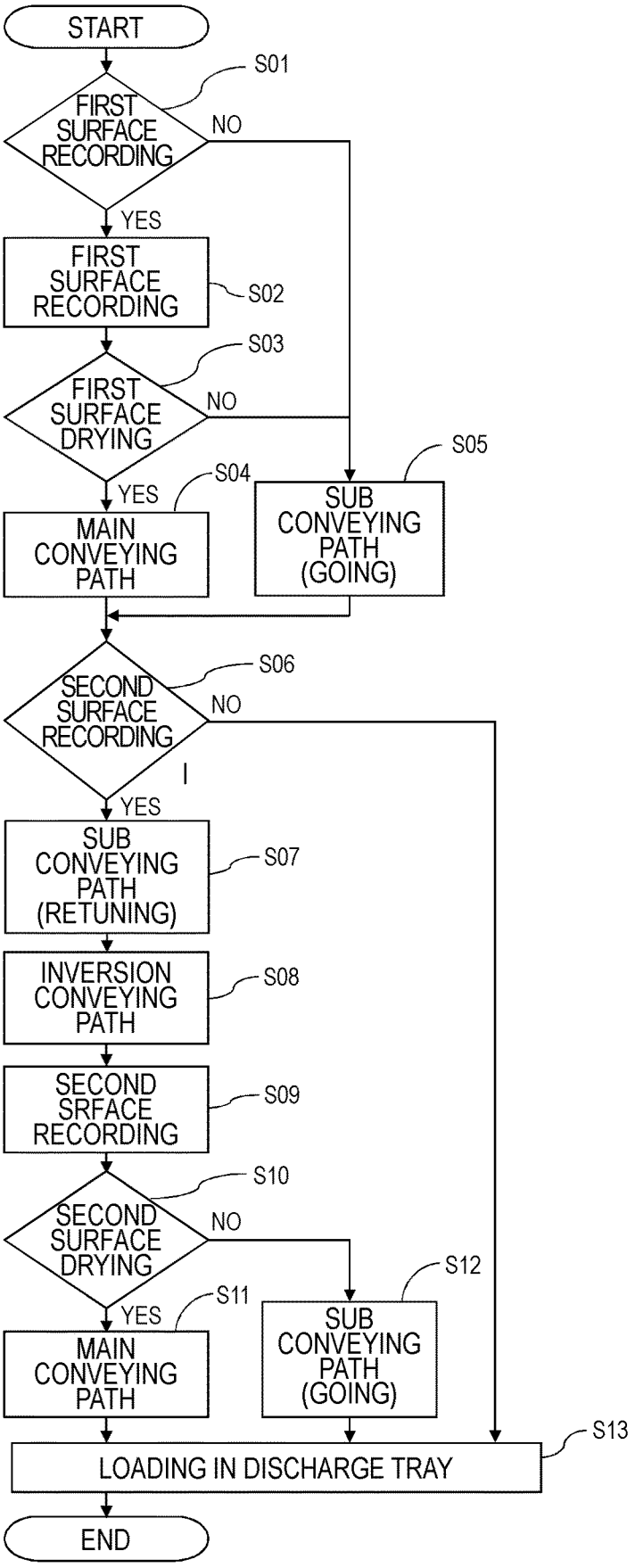
FIG. 4 is a flowchart showing the recording surfaces and patterns with or without heat drying.

Then, the conveying path for the recording medium S in the print portion 2 will be described. FIG. 4 is a flowchart for illustrating the setting processing of the conveying form to be executed by the print controller 202 when the print engine unit 200 receives a job. Below, referring to FIGS. 5A to 5F, respective conveying paths will be described in detail.

When a record command is inputted, the print controller 202 moves the recording head 7 to the recording position using the maintenance control portion 210 and the head carriage control portion 208. Further, the print controller 202 performs heating of the heat generation member 51 and driving of the pressure roller 56 in the heating portion 23 using the heat drying control portion 211, resulting in the state in which the recording medium S can be subjected to heat drying. Subsequently, the print controller 202 drives the feed unit 6 according to a record command using the conveying control portion 207.

Figure 5A:
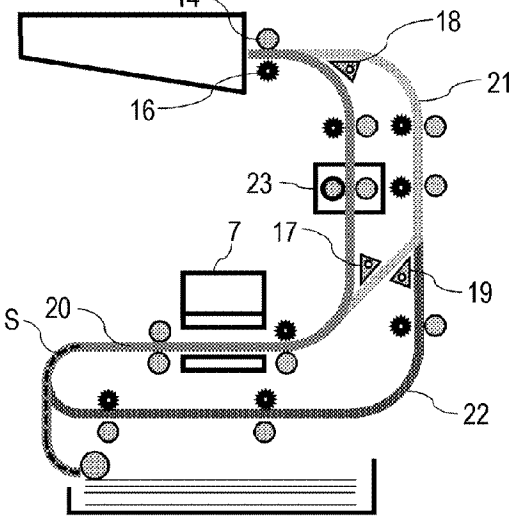
FIGS. 5A to 5F are views showing conveying paths for a recording medium.
Figure 5B:
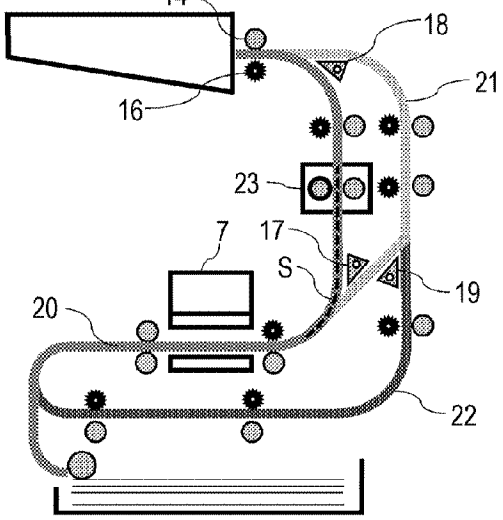

The recording medium S stacked uppermost in the cassette 5 is separated from the second and subsequent recording media S by the feed unit 6. Then, the recording medium S is conveyed toward the recording region between the platen 12 and the recording head 7 while being nipped by the conveying roller 13 and the pinch roller 15 present in the main conveying path 20 (FIG. 5A).

Figure 5C:
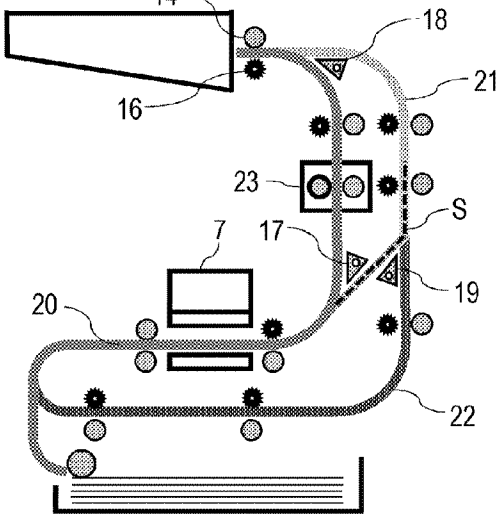

When it is determined that recording is performed on the first surface in a step S01, with a step S02, an ink is discharged from a plurality of discharge ports provided at the recording head 7 toward the first surface of the recording medium S according to a record command in the recording region. The recording medium S which has completely gone through the recording operation on the first surface is conveyed to the downstream side in the conveying direction while being guided by the conveying roller 13 and the spur 16 on the downstream side of the recording head 7. The recording medium S conveyed to the branching part of the main conveying path 20 and the sub conveying path 21 is conveyed to the conveying path selected by the switching operation of the first flapper 17 based on the determination of the necessity of passing through the heating portion 23 in a step S03. Namely, when the recording medium S is required to pass through the heating portion 23, the process proceeds to a step SO4, where the recording medium S is guided by the main conveying path 20 (FIG. 5B), and passes through the heating portion 23, which promotes heat drying of the first surface. When heat drying of the first surface is unnecessary, or when recording has not been performed on the first surface, the process proceeds to a step SO5, where the recording medium S is guided to the sub conveying path 21 (FIG. 5C).

Figure 5D:
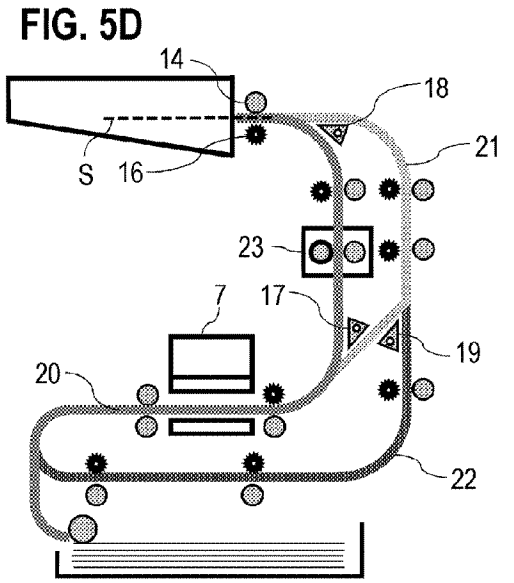
Figure 5E:
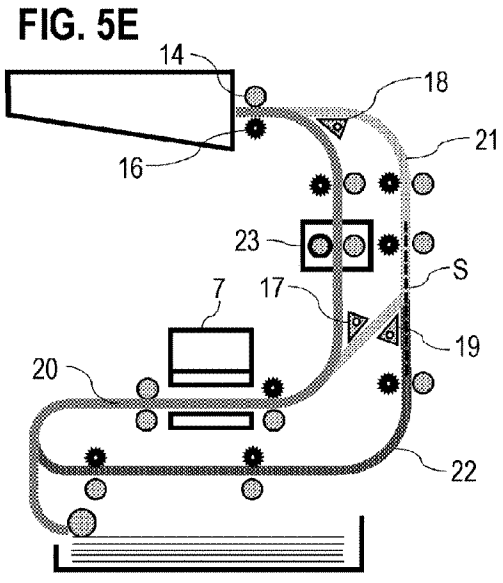
Figure 5F:
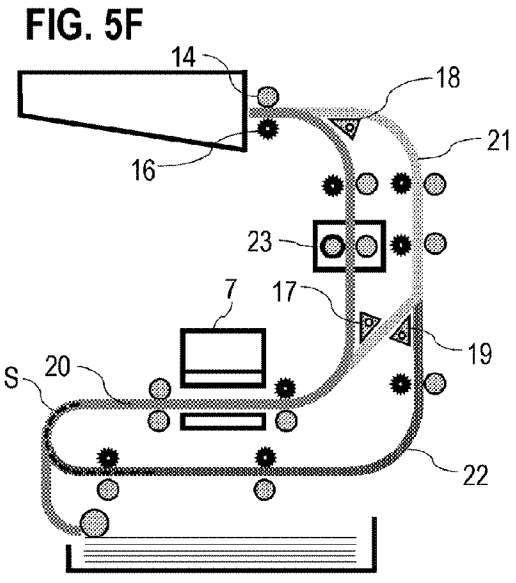

Subsequently, it is determined whether or not recording is performed on the second surface of the recording medium S in a step S06. When recording is not performed, the process jumps to a step S13, where the recording medium S is stacked in the discharge tray 24 by the conveying roller 13 and the discharge roller 14. When recording on the second surface is performed, the process proceeds to a step S07, where a switch back operation is performed after the rear end in the conveying direction of the recording medium S has passed through the second flapper 18 (FIG. 5D). Namely, the second flapper 18 is switched so that the rotation of the conveying roller 13 and the discharge roller 14 are reversed, and the recording medium S whose conveying direction is reversed is guided to the sub conveying path 21. The switch back operation causes the recording medium S whose conveying direction is reversed to run in the opposite direction on the sub conveying path 21, and the process proceeds to a step S08, where the recording medium S is guided to the inversion conveying path 22 (FIG. 5E). At this step, the third flapper 19 previously performs a switching operation so that the recording medium S may be guided to the reversal conveying path 22. Incidentally, of the plurality of conveying rollers 13 arranged at respective conveying paths, the reversibly rotatable configured roller may be only the roller involved in the switch back operation. The recording medium S guided to the reversal conveying path 22 goes to a step S09, and is conveyed to the upstream side of the recording head 7 with the second surface facing the discharge port surface 7*a* side of the recording head 7 (FIG. 5F), and the recording operation on the second surface is performed in the recording region. The operation afterward until the recording medium S is stacked in the discharge tray 24 is the same as with the conveying method after the recording operation on the first surface. All the recording patterns and the conveying paths are shown in FIG. 6.

The positional relationship between the main conveying path 20 including the heating portion 23 and the sub conveying path 21 not including the heating portion 23 has no particular restriction. The recording apparatus 1 in the present embodiment is configured on the assumption that the conveying path for heat drying the recording medium S is mainly used. For this reason, the length of the conveying path from the branching part from the sub conveying path 21 to the merging part with the sub conveying path 21, in the main conveying path 20 is generally set shorter than the length of the conveying path for the sub conveying path 21 as shown in, for example, FIG. 1. As a result, on the assumption that the heating portion 23 is used in the recording operation, the time until the completion of the recording operation can be shortened.

Further, when it is determined regarding the heating portion 23 from the recording information or the like that the recording medium S does not pass through the heating portion 23, heating of the heat generation member 51 and driving of the pressure roller 56 are not performed. Alternatively, a stand-by state is kept in which electric power supply to the heat generation member 51 is limited to a prescribed preparatory heating. As a result, the power consumption can be reduced.

Figure 11:
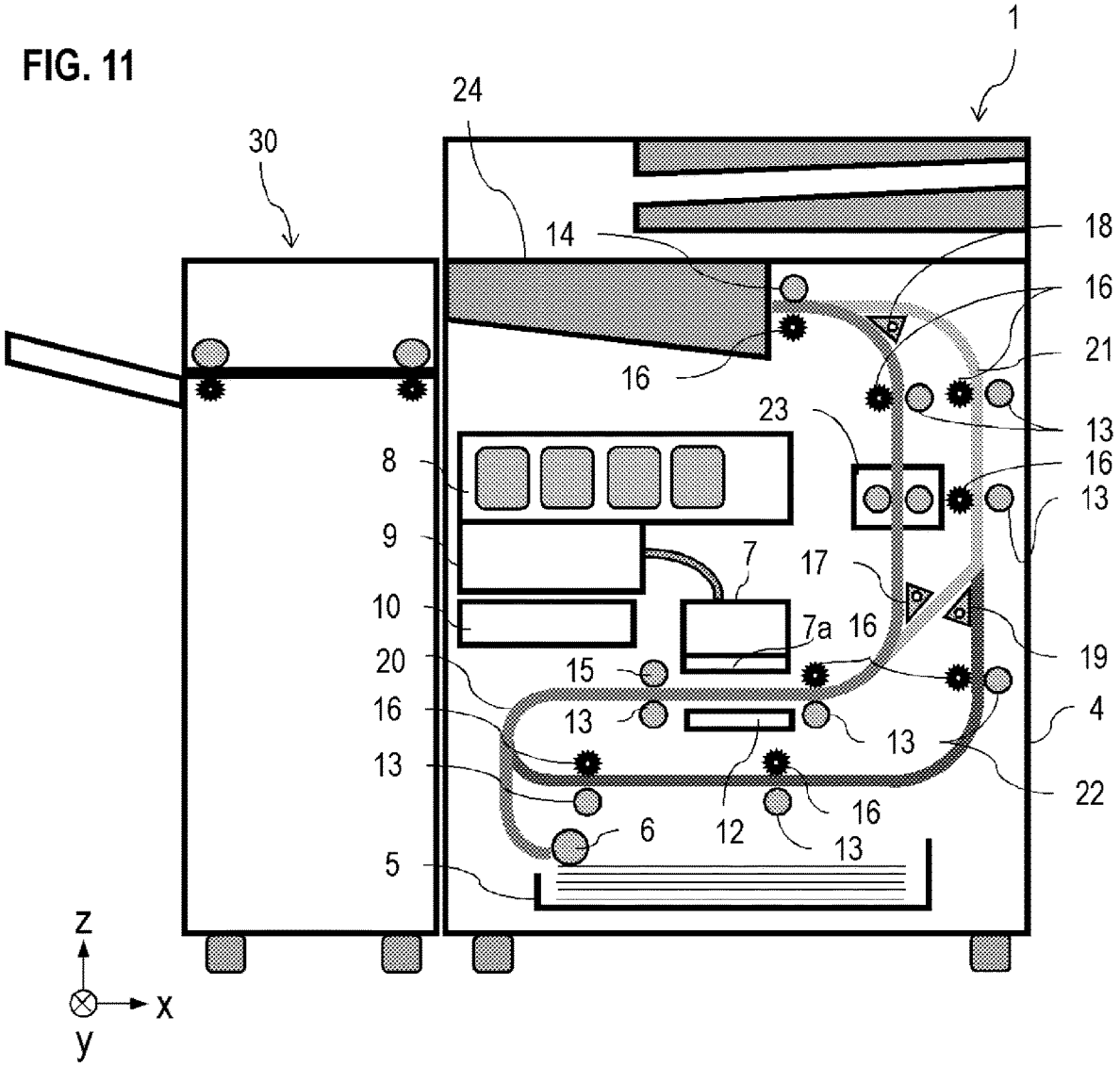
FIG. 11 is a view showing another apparatus configuration example of the image recording apparatus of the embodiment.

In FIG. 1, the recording medium S is conveyed so as to be stacked in the discharge tray 24. The conveying destination is not limited to this. For example, as with the apparatus configuration example shown in FIG. 11, as prescribed post processing on the recording medium having an image recorded thereon, it may be configured such that the recording medium S is conveyed to a finisher device (post processing device) 30 including various processing mechanisms of stapling, punching, bending, binding, and the like.

Further, in the case where recording is performed on a plurality of recording media S successively, when the length of the conveying path of the reversal conveying path 22 is equal to or larger than the length in the conveying direction of the recording medium S, the recording operation of the next recording medium S can be performed with the recording medium S held on the reversal conveying path 22. Further, the recording medium S is held in the apparatus, which enables recording to be continued without hindering the processing of the finisher device to be connected. Below, the control including the state in which the recording medium S is held on the reversal conveying path 22 will be referred to as the retention mode. In the case of the retention mode, page order in which image recording is performed is varied from the page order for normal image recording. As a result, the required time for the overall recording operation of a plurality of recording media S can be shortened, and the recording media S can be stacked in the discharge tray 24 in the page order.

Referring to FIGS. 7A to 7F, 8G to 8L, 9M to 9R, and 10S to 10V, a detailed description will be given to the movement of the recording medium and the image recording order for performing recording for a total of four pages of respective opposite sides of two recording media in the retention mode. Namely, there are images to be recorded over four pages, and the four images divided one for each page are recorded on the front surface (first surface) and the back surface (second surface) of the first recording medium, and the front surface (third surface) and the back surface (fourth surface) of the second recording medium in this order. The first recording medium and the second recording medium which have completely gone through image recording are discharged in such a manner that the back surface of the first recording medium and the front surface of the second recording medium oppose and overlap each other. In FIGS. 7A to 7F, 8G to 8L, 9M to 9R, and 10S to 10V, the recording medium is indicated with a dotted line, and the numeric described on the recording medium represents the page to be recorded on the recording medium surface. FIGS. 7A to 7F, 8G to 8L, 9M to 9R, and 10S to 10V each shows the case where all the total number of four pages on respective opposite sides of the two recording media require heat drying.

Retention Mode

Figure 7A:
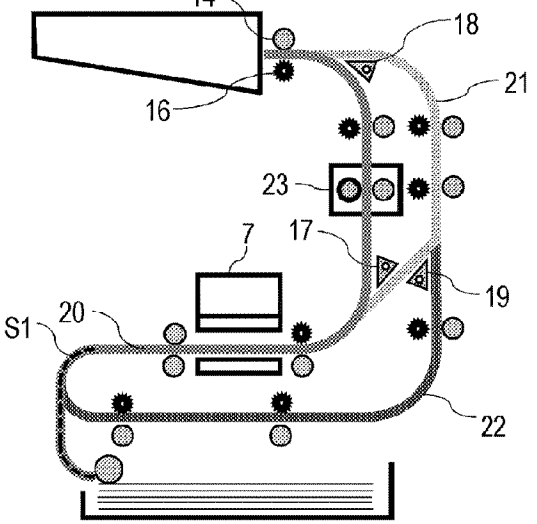
FIGS. 7A to 7F are views showing the conveying paths for a recording medium in the pattern 5 using a retention mode.
Figure 7B:
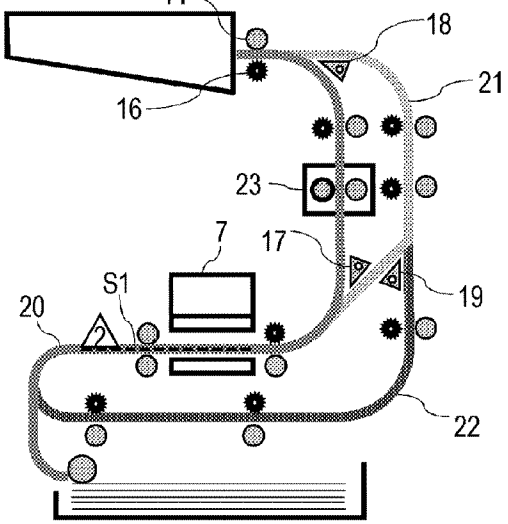
Figure 7C:
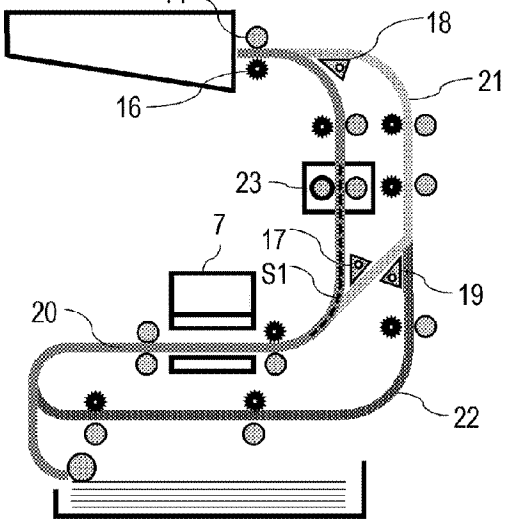
Figure 7D:
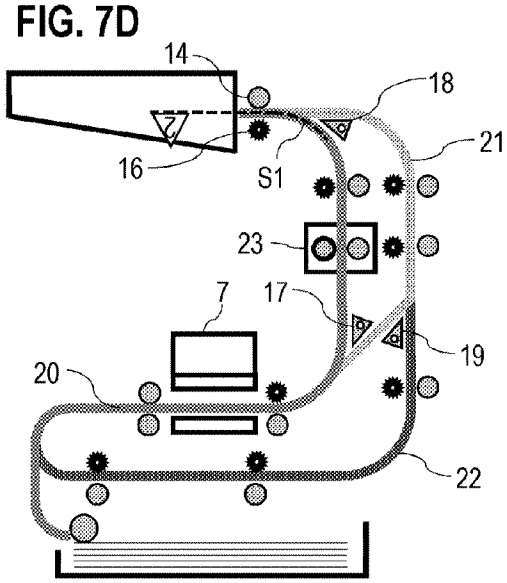
Figure 7E:
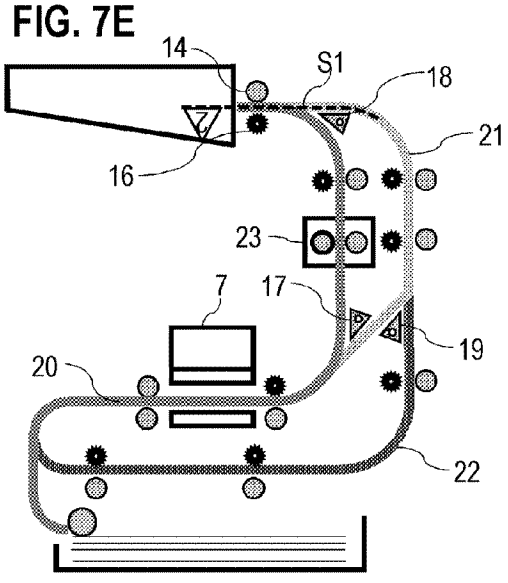
Figure 7F:
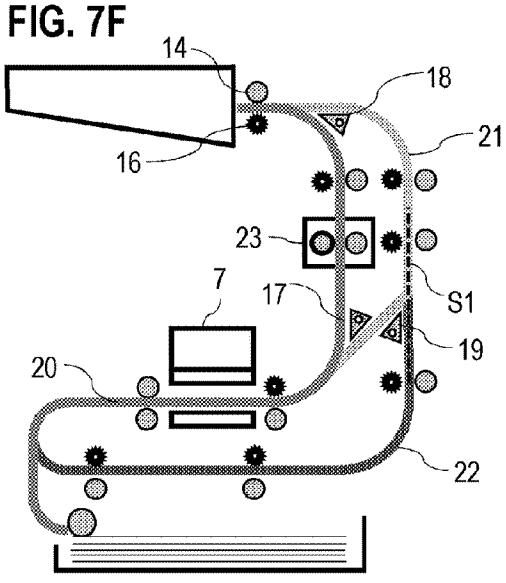

As with a general conveying path, a recording medium S1 as the first recording medium stacked uppermost in the cassette 5 is separated from second and subsequent recording media S by the feed unit 6, and is conveyed to the main conveying path 20. The recording medium S1 is conveyed toward the recording region between the platen 12 and the recording head 7 while being nipped by the conveying roller 13 and the pinch roller 15 in the main conveying path 20 (FIG. 7A). The separated first recording medium S1 passes through the main conveying path 20, and undergoes recording of the image (second image) to be formed on the second page of the four pages of the output product at the recording portion (FIG. 7B). The recording surface of the recording medium S1 at this step becomes the surface (second surface) corresponding to the second page of the output product. The recording medium S1 passes through any of the main conveying path 20 and the sub conveying path 21 according to the necessity of passing through the heating portion 23 (FIG. 7C), and reaches the discharge roller 14 (FIG. 7D). After the rear end in the conveying direction of the recording medium S1 has passed through the second flapper 18 (FIG. 7E), the recording medium S1 is reversed in terms of the conveying direction by a prescribed switch back operation including to reverse the rotation of the discharge roller 14 or the conveying roller 13, and is guided to the reversal conveying path 22 (FIG. 7F).

Figure 8G:
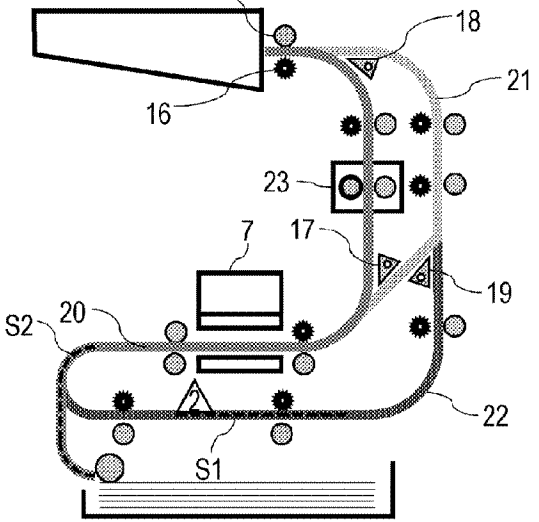
FIGS. 8G to 8L are views showing the conveying paths for a recording medium in the pattern 5 using the retention mode.
Figure 8H:
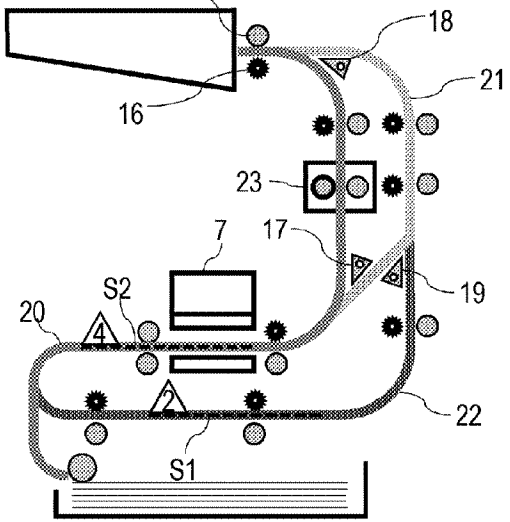
Figure 8I:
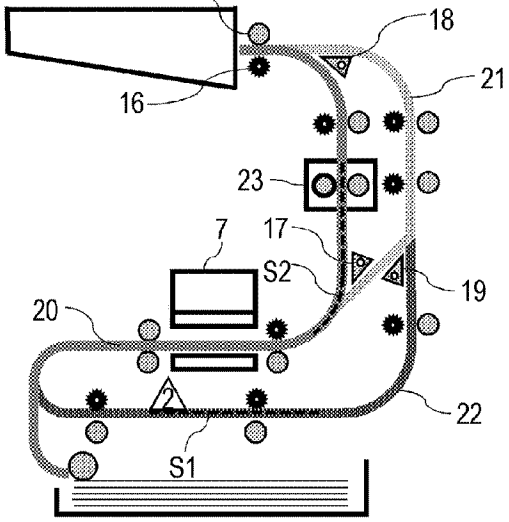
Figure 8J:
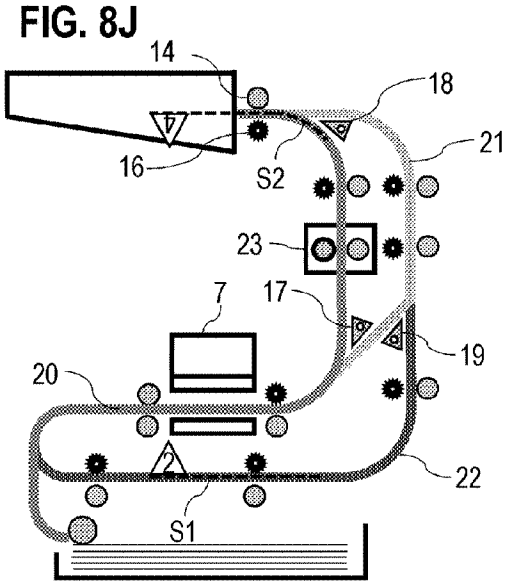
Figure 8K:
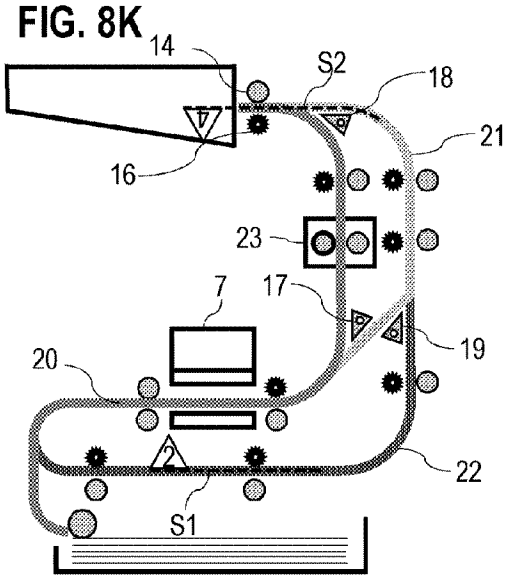
Figure 8L:
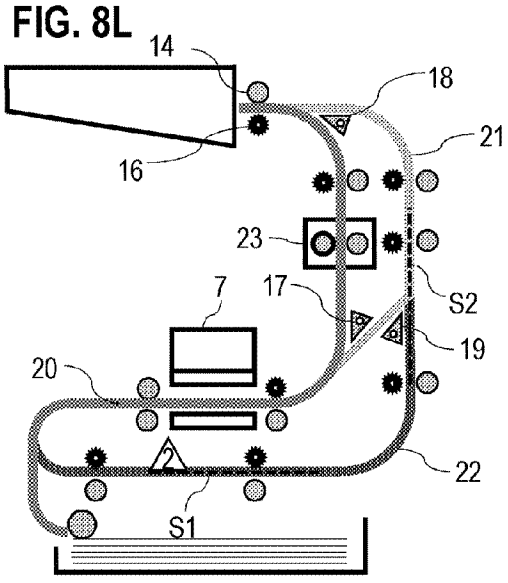

With the first recording medium S1 guided to and held on the reversal conveying path 22 (FIG. 8G), a second recording medium S2 as a second recording medium is conveyed to the recording portion, and undergoes recording of the image (fourth image) to be formed on the fourth page of the output product (FIG. 8H). The recording surface of the recording medium S2 at this step becomes the surface (fourth surface) corresponding to the fourth page of the output product. After passing through the recording portion, the recording medium S2 passes through any of the main conveying path 20 and the sub conveying path 21 (FIG. 81), and reaches the discharge roller 14 (FIG. 8J) as with the first recording medium S1. Then, after the rear end has passed through the second flapper 18 (FIG. 8K), the recording medium S2 is guided by the switch back operation to the reversal conveying path 22 (FIG. 8L).

Figure 9O:
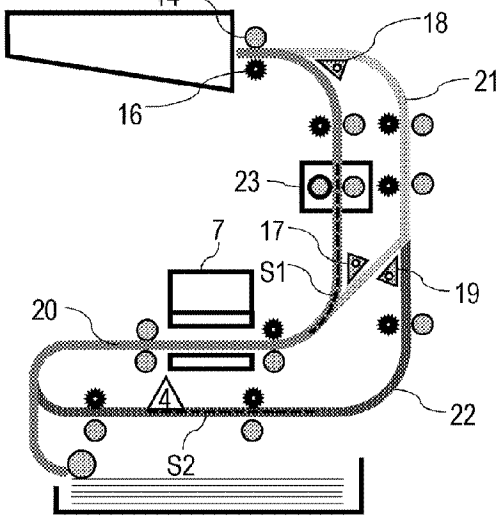
FIGS. 9M to 9R are views showing the conveying paths for a recording medium in the pattern 5 using the retention mode.
Figure 9N:
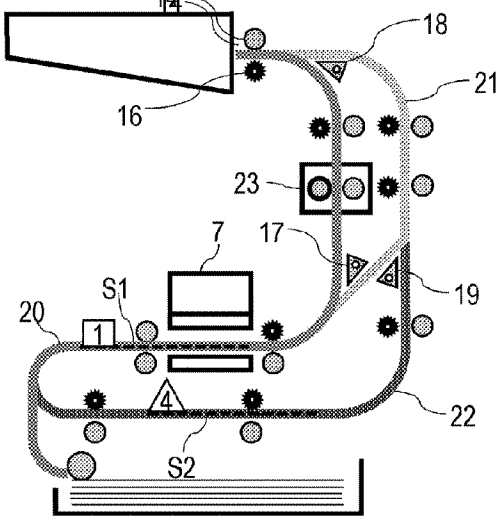
Figure 9M:
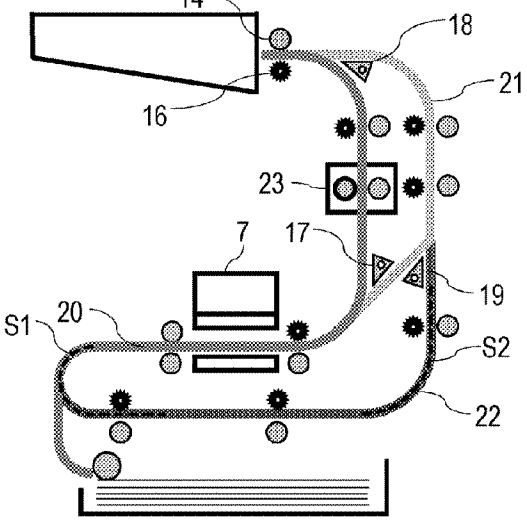
Figure 9R:
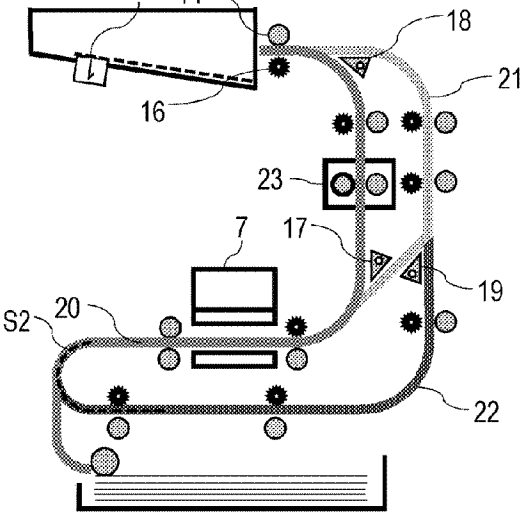
Figure 9Q:
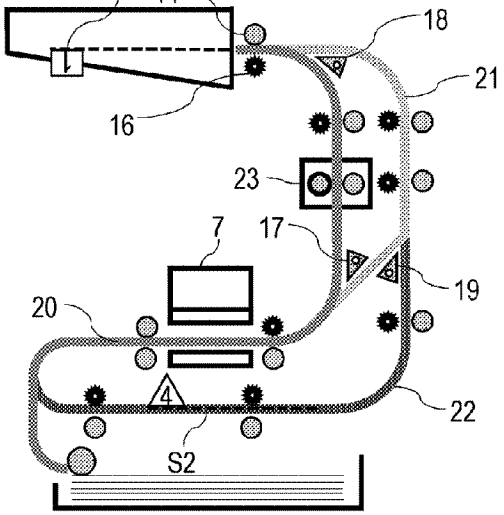
Figure 9P:
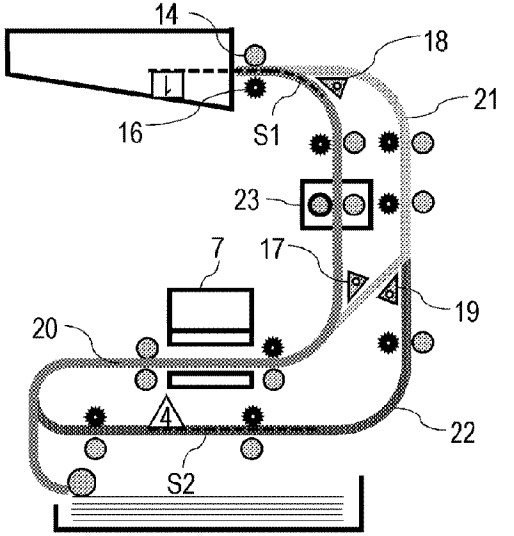

Simultaneously with guiding of the recording medium S2 to the reversal conveying path 22, the first recording medium S1 passes through the reversal conveying path 22, and is conveyed again to the main conveying path 20 with the unrecorded surface facing the recording portion (FIG. 9M). At the recording portion, the image (first image) to be formed on the first page of the four pages of the output product is recorded on the unrecorded surface of the recording medium S1 (FIG. 9N). The recording surface of the recording medium S1 at this step becomes the surface (first surface) corresponding to the first page of the output product. Subsequently, the recording medium S1 passes through any of the main conveying path 20 and the sub conveying path 21, and is discharged to the discharge tray 24 (FIGS. 90 to 9R). In the meanwhile, the second recording medium S2 is held on the reversal conveying path 22. Likewise, the second recording medium S2 also passes through the reversal conveying path 22, and is conveyed again with the unrecorded surface facing the recording portion (FIG. 9R).

Figure 10U:
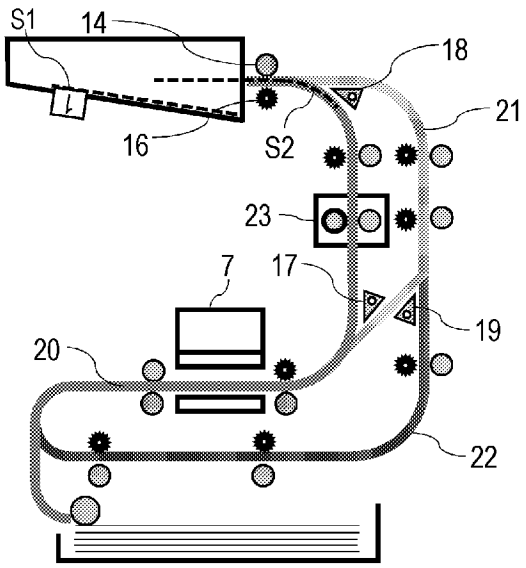
FIGS. 10S to 10V are views showing the conveying paths for a recording medium in the pattern 5 using the retention mode.
Figure 10T:
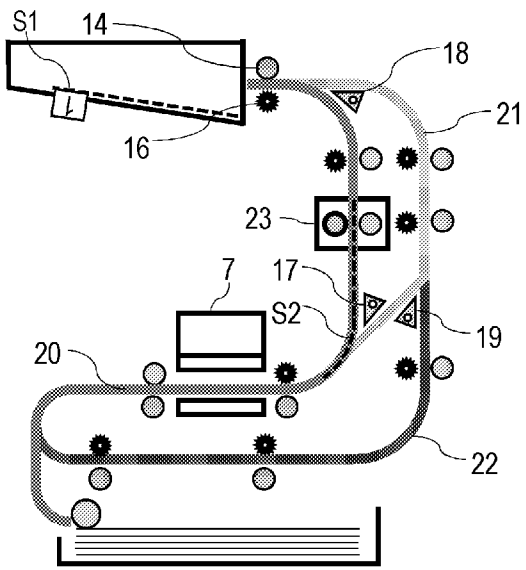
Figure 10S:
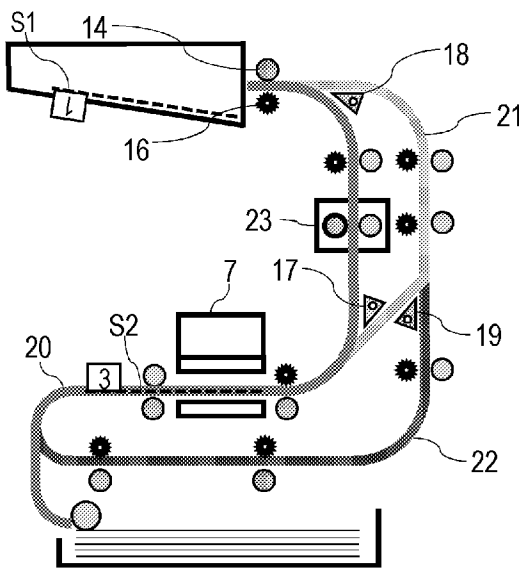

The recording medium S2 undergoes recording of the image (third image) to be formed on the third page of the four pages at the recording portion (FIG. 10S). The recording surface of the recording medium S2 at this step becomes the surface (third surface) corresponding to the third page of the output product. Subsequently, the recording medium S2 passes through any of the main conveying path 20 and the sub conveying path 21, and is discharged to the discharge tray 24 (FIGS. 10T and 10U).

Figure 10V:
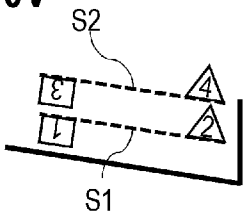

As described above, the recording medium is held on the reversal conveying path, and the order in which image recording is performed is varied from the page order for general image recording. As a result, the productivity for double-sided recording can be improved, and further, stacking in the discharge tray in the page order is possible (FIG. 10V).

Further, with the control of the recording operation of the present embodiment, the recording medium with an image recorded on one surface thereof is promoted to be dried during the retention period on the reversal conveying path, namely, while waiting for the completion of the recording operation of another recording material for image recording on another surface. Namely, the retention period on the reversal conveying path can be grasped as the drying promoting period for the recording medium. As a result, the suppression of the deformation of the recording medium S, the prevention of the jam in the conveying path, and a further improvement of the aligning performance in the discharge tray can be accordingly expected. Further, ordinarily, namely, in the case where image recording on the opposite surface is performed without the retention period, when a heat treatment becomes necessary at the heat drying portion, the necessity of the heat treatment at the heat drying portion may be able to be eliminated by taking the drying by the retention period into account. As a result, it becomes possible to shorten the time until the completion of the recording operation.

Incidentally, in conjunction with FIGS. 7A to 7F, 8G to 8L, 9M to 9R, and 10S to 10V, a description has been given to the operation with one recording medium held on the reversal conveying path. When the total length in the conveying direction of the recording medium to be retained is larger than the reversal conveying path length, a plurality of recording media may be held on the reversal conveying path.

Further, in order to improve the productivity, the conveying rollers in the sub conveying path and the reversal conveying path may perform conveyance at a higher speed than that of the conveying roller in the main conveying path. Any timing at which the succeeding recording medium starts to be conveyed is acceptable even the timing is before the preceding recording medium is completely guided to the reversal conveying path unless the recording media collide with each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100437, filed on Jun. 9, 2020, which is hereby incorporated by reference herein in its entirety.

What is claimed is:

1. An image recording apparatus comprising:

a stacking portion on which a recording medium is stacked;

a recording portion for recording an image on the recording medium;

a heating portion for heating the recording medium recorded by the recording portion;

a discharge portion for discharging the recording medium recorded by the recording portion;

a first path for conveying the recording medium in order of the stacking portion, the recording portion, the heating portion, and the discharge portion;

a second path branching off from the first path between the recording portion and the heating portion, and merging with the first path downstream of the heating portion; and a third path for connecting the second path and a part of the first path between the stacking portion and the recording portion, and inverting a recording surface of the recording medium.

2. The image recording apparatus according to claim 1, wherein the recording medium of which conveying direction is reversed is guided to the third path via the second path.

3. The image recording apparatus according to claim 2, wherein the recording medium to be guided to the third path include a recording medium of which conveying direction is reversed after passing through the heating portion, and a recording medium of which conveying direction is reversed after being guided to the second path.

4. The image recording apparatus according to claim 2, wherein the second path is provided with a reversibly rotatable conveying roller, and wherein the conveying direction of the recording medium is reversed by reversing a rotation of the conveying roller.

5. The image recording apparatus according to claim 1, wherein a length of the third path is equal to or greater than a length in the conveying direction of the recording medium.

6. The image recording apparatus according to claim 1, wherein a length of the first path from a branching part thereof, from which the second path branches off, to a merging part thereof, at which the second path merges, is smaller than a length of the second path.

7. The image recording apparatus according to claim 1, further comprising a discharge tray on which the recording medium discharged by the discharge portion is stacked.

8. The image recording apparatus according to claim 1, further comprising a post processing apparatus for performing prescribed post processing on the recording medium discharged by the discharge portion.

9. The image recording apparatus according to claim 1, wherein the heating portion is not driven in a case where the recording medium is discharged by the discharge portion without passing through the heating portion.

10. The image recording apparatus according to claim 1, wherein a heating system of the heating portion is at least one of a plurality of heating systems including a contact heating system for bringing a heating member into contact with the recording medium, and a warm air system for blowing warm air to the recording medium.

11. The image recording apparatus according to claim 1, wherein while a first recording medium is on the third path, the recording portion records an image on a second recording medium, which is different from the first recording medium.

12. The image recording apparatus according to claim 1, wherein in a case where a first image is recorded on a first surface of a first recording medium, a second image is recorded on a second surface, which is a back surface of the first surface of the first recording medium, a third image is recorded on a third surface of a second recording medium, which is different from the first recording medium, a fourth image is recorded on a fourth surface, which is a back surface of the third surface of the second recording medium, and the first recording medium and the second recording medium are discharged by the discharge portion so as to be stacked with the second surface and the third surface facing each other, the recording portion records the images on the first recording medium and the second recording medium in order of the second image, the fourth image, the first image, and the third image.

13. The image recording apparatus according to claim 12, wherein the first recording medium having the second image recorded on the second surface is retained on the third path until the recording portion records the fourth image on the fourth surface of the second recording medium, and the second recording medium having the fourth image recorded on the fourth surface is retained on the third path until the recording portion records the first image on the first surface of the first recording medium.

14. The image recording apparatus according to claim 1, further comprising:

an image reading portion for reading an image of a document sheet, wherein the recording portion is capable of recording the image, which has been read by the image reading portion, on the recording medium.

* * * * *